US005940901A

United States Patent [19]

Haslauer

[11] Patent Number: 5,940,901

[45] Date of Patent: Aug. 24, 1999

[54] TREATMENT FACILITY FOR APPLICATION OF A TUB AND/OR A STEAM BATH

[76] Inventor: Paul Haslauer, Moosstrasse 103, A-5020 Salzburg, Austria

[21] Appl. No.: 08/961,705

[22] Filed: Oct. 31, 1997

[30] Foreign Application Priority Data

Oct. 31, 1996 [DE] Germany ..... 196 45 077

[51] Int. Cl.[6] ..... A61H 33/06

[52] U.S. Cl. ..... 4/524; 4/525

[58] Field of Search ..... 4/524–534; 392/386, 392/387, 403; 126/204, 366, 367, 369, 369.2, 369.3

[56] References Cited

U.S. PATENT DOCUMENTS

| | | | |
|---|---|---|---|
| 758,207 | 4/1904 | Hamilton | 4/532 |
| 1,334,978 | 3/1920 | Trachte et al. | 126/367 |
| 1,425,423 | 8/1922 | Thomas | 4/533 |
| 2,404,705 | 7/1946 | Handelan | 126/367 |
| 2,747,569 | 5/1956 | Holm et al. | 126/367 |
| 3,275,800 | 9/1966 | Kuoppamaki et al. | 4/524 |
| 3,588,470 | 6/1971 | Husband | 4/524 |
| 3,786,231 | 1/1974 | Torvfelt | 4/524 |
| 4,944,286 | 7/1990 | Millington | 126/367 |
| 5,461,870 | 10/1995 | Paradowski | 62/11 |

FOREIGN PATENT DOCUMENTS

| | | | |
|---|---|---|---|
| 3127691 | 4/1982 | Germany | 4/524 |
| 17477 | 9/1891 | United Kingdom | 4/524 |
| 2063665 | 6/1981 | United Kingdom | 4/531 |

*Primary Examiner*—Charles R. Eloshway
*Attorney, Agent, or Firm*—Nikolai, Mersereau & Dietz, P.A.

[57] ABSTRACT

An improved treatment facility for the application of a tub and/or steam bath which includes a heating facility for heating up stones and one or more water basins or containers associated with tubs or steam baths into which the heated stones can be immersed to generate steam. The stones are housed in a fireproof hold-and-carry container which is able to hold a great number of stones and which is in the form of an open network or cage designed to be penetrable by air and water. A lift and carry device including a pivoting crane arm is provided to convey the container including the heated stones back and forth from the heating facility to the one or more provided water basins or containers and to immerse a desired portion of the heated stone in the water.

18 Claims, 3 Drawing Sheets

TREATMENT FACILITY FOR APPLICATION OF A TUB AND/OR A STEAM BATH

BACKGROUND OF THE INVENTION

The invention concerns a treatment facility for application of a tub and/or steam bath.

The use of sauna and steam baths have always enjoyed great popularity.

For a sauna application, stones are heated to very high temperature in the sauna room. During this period the room fills with dry, hot air. During the so-called infusion with water (mixed with additives, if necessary), the latter is poured over the hot stones periodically. This causes the instant rise of humidity in the room.

With a steam bath, water vapor, with or without additives, is continuously or periodically piped into the bathing room. Although this generates significantly lower room temperatures than with a sauna bath, the humidity is significantly higher.

SUMMARY OF THE INVENTION

The task of the present invention is the creation of a new type of treatment facility for the application of a tub and/or steam bath, characterized by its advantages over conventional tub and/or steam bath facilities.

The invention proposes the heating of many stones to high temperature. The highly heated stones, serving as a thermal store, are then submerged into a water basin with a suitable hold-and-carry container. In a bath application, the bath water may be heated in this manner. Simultaneously, it also generates a strong steam burst. The stones may also be totally or partially submerged in separate water containers or troughs, if the primary intention is the generation of steam above them.

It is significant that the preferably highly heated stones and the subsequent quenching of the stones in a watery solution, like bath water, causes physical processes that release active agents contained in the stones.

It is only through an initial strong, or super-strong heating and the sudden subsequent contact with water that active agents, minerals, etc. contained in the stones can be dissolved and transferred into the bath water, or be dissolved in the bath water.

Furthermore, it shall be pointed out that, according to the invention, thermal waters may also be used, either as bath water or for the generation of steam. The shock reaction caused by the immersion of strongly heated stones—they can be heated to a red glow—into the bath water causes still unknown physical processes, in which the shock-type superheating not only dissolves substances contained in the stones, bath or thermal waters, but also releases ingredients already contained in the water or thermal water. It has been demonstrated by the invention that part of the active ingredients contained in the water, particularly in thermal water, cannot be released other than by the shock reaction caused when locally strong superheated stones come into sudden contact with cooler water.

Immersion of the heated stones also generates the mentioned water vapor, where the sudden transition from the aqueous to the vapor phase causes the steam to drag along ingredients or minerals contained in the stones, permeating the breathing air of the bathing room and contributing to the increase of the well-being of the bathers.

The invented hold-and-carry container [device] for holding the superheated stones consists, preferably, of a type of cage, which is subsequently also referred to as the stone-cage.

Preferably provided is also a conveyor and carrying device, particularly in form of a crane, with which a hold-and-carry container, preferably shaped as stone-cage, can be moved from the heating facility to the bathing or vaporizing facilities.

For this purpose, the stone-cage-like hold-and-carry container lowers the very strongly heated and superheated stones into the respective tub or water-trough without touching the tub or the water-trough (which also prevents any damage of the tub, water-trough, and stone-cage). Furthermore, the stones shall not be left in the tub-trough during the whole bath, but only be dipped into the water for a pre-selected period—i.e. they are held suspended in the water—to be withdrawn again from the water basin after the shock-like contact effect of the possibly to red-glow heated stones with the water.

Preferably, the heating facility consists, for example, of a gas-fired open fireplace, in which gas streams out of a number of jets. The size and cross-section of the fireplace is preferably fitted to match the cross-section of the cage or a similar hold-and-carry container. Preferably, the hot air can also rise through the whole cage and heat the stones contained therein from the bottom up to the top in this way.

It has shown to be especially advantageous when diverter baffles, slanted upward and away from its exterior surface, surround the preferably cage-shaped hold-and-carry container.

This offers the possibility that the conveyor and carrying device can lower the cage only partially to heat the bath water in a first tub, and/or to produce steam surges. After that, the cage can be moved to a next bath or water station for submerging those stones not previously lowered into the water. To assure that the steam generated by the first lowering into the bath water does not contact and/or cool the upper layer of stones or dissolves mineral substances, the largest part of the rising steam is conducted via a lower baffle towards the outside.

For example, if three bathing stations arete be heated with a stone-cage device, such baffles are preferably provided in two stages.

Further advantages, details, and features of the invention are shown in the drawings for the following implementation example. Shown in detail are:

IN THE DRAWINGS

FIG. 1: a schematic top view of the invented treatment facility, contained in one room;

FIG. 2: a schematic side view of a fireplace, with the stone cage lowered upon it; and FIG. 3: a schematic vertical axial cut through the stone cage filled with stones, lowered to a certain height in a first bath tub.

DESCRIPTION OF THE PREFERRED EMBODIMENT

Figure 1:
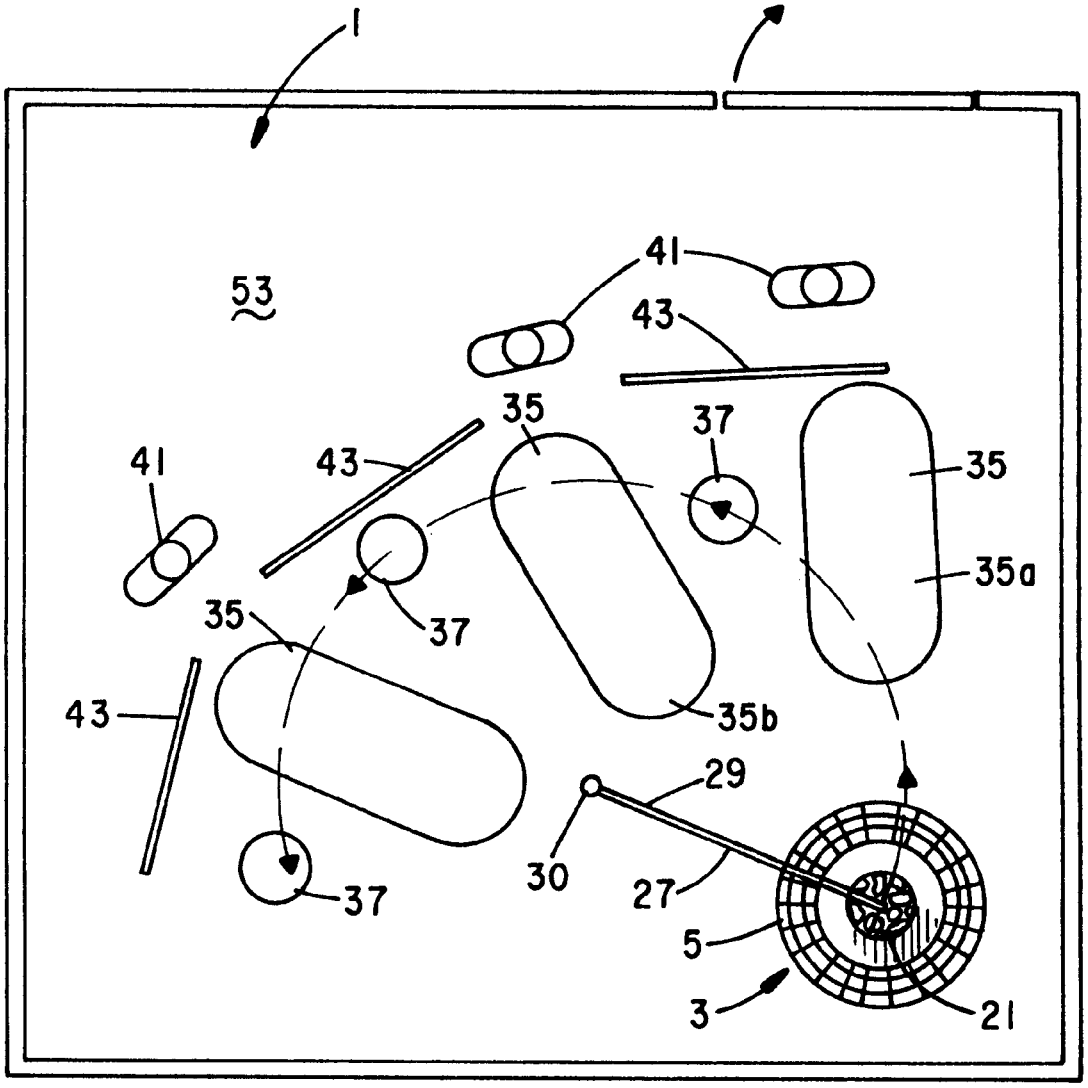

FIG. 1 shows a room 1 in schematic top view, in which an invented treatment facility for a tub and/or steam bath is provided.

Figure 2:
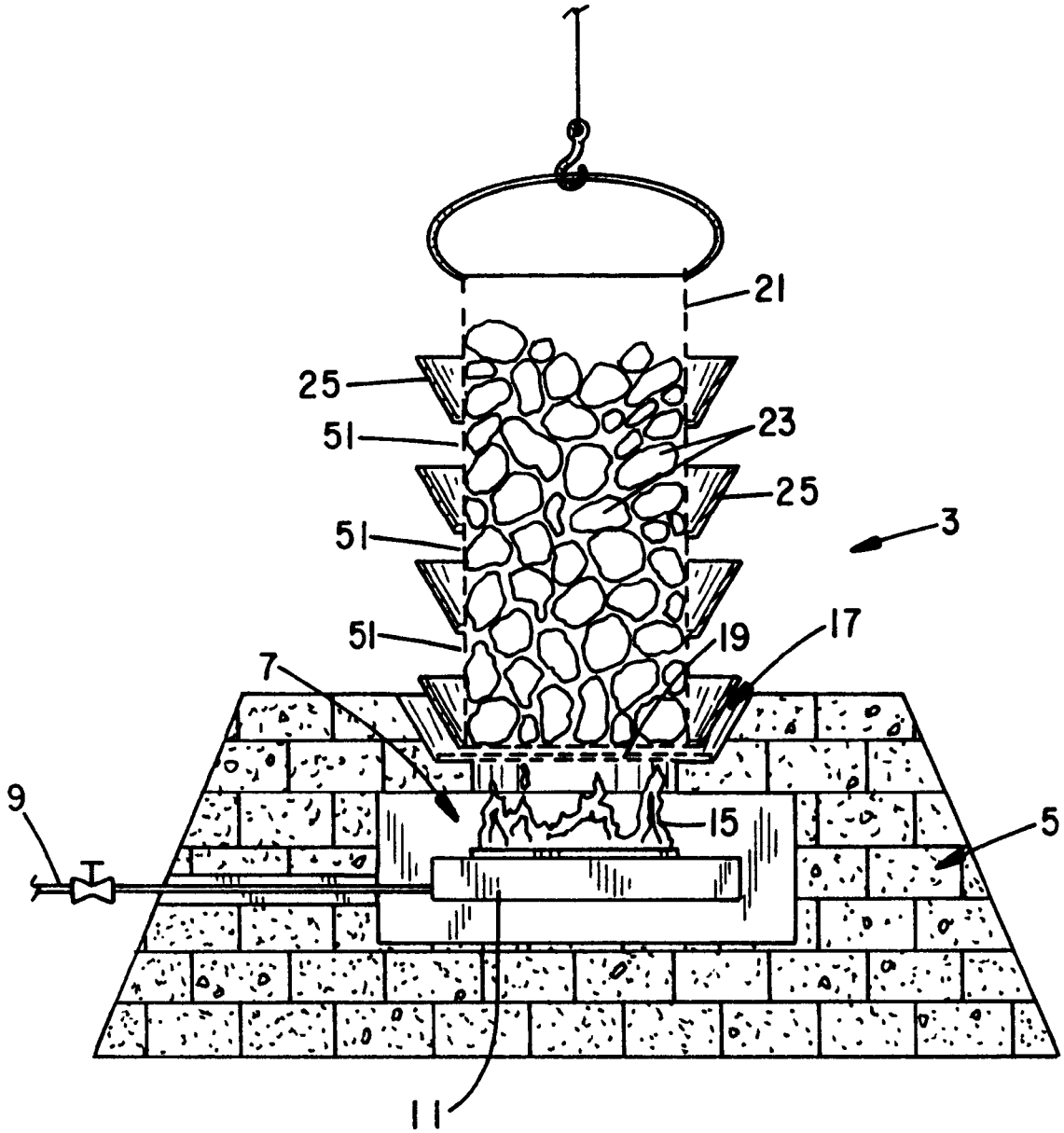

The facility consists of a heating facility 3, provided in the implementation example in a corner of room 1. As can be seen in FIG. 2, the heating facility 3 consists of an at least partially stump-shaped masonry cone basis 5, with an open fireplace in its interior. In the shown implementation example, it is fired by gas, with the gas needed for the firing being conducted through a shut-off gas pipe 9 to a so-called heating register 11 with gas jets for generating the flames 15.

In its upper area, the basis 5 has an opening 17 that is fitted or covered with a heat-permeable screen 19 or a similar device in such manner that a hold-and-carry container 21 can be placed on it.

The hold-and-carry container (21), subsequently also referred to briefly as stone-cage, may be constructed like a cage with a lattice mesh, where the opening of the mesh must be held large enough to prevent the comparably large-dimensioned stones 23 from falling out of the stone-cage 21. While the configuration may take other forms, as can be seen in the figures, the stone cage 21 is preferably rather taller than it is wide and may be cylindrical in shape. The stone cage is generally vertically disposed so that it may be described as having a vertical dimension or height greater than its horizontal dimensions.

The stones 23 can consist of different rock materials, and be selected and assembled in a way fitting the purpose.

Furthermore, at different heights of the stone-cage 21, surrounding, or essentially surrounding, baffles 25 are provided, which are equipped with a slightly inclining component running up and away from the cage. Their significance shall be explained later.

Finally, it shall be mentioned here that a conveyor and carrying device 27 is also provided for moving the stone-cage 21 in the shown implementation example. It consists of a crane with a swivel arm 29, or a crane-like holding structure.

As evident from the schematic top view of FIG. 1, three tubs 35 have been put up as an example in the swivel range of the conveyor and carrying device 27 this may be filled with bath water (to which certain ingredients may be added). In accordance with the schematic representation of FIG. 1, the tubs 35 and water containers 37 are arranged along a generally arcuate pattern so as to be addressed by the conveyor and carrying device 27 using crane arm 29 which swivels about a central pivot 30.

Furthermore, additional water containers or troughs 37 may also be placed between the tubs.

The following explains the implementation of a bath and/or steam application.

Before application of the actual bath, the bathers may —in the shown implementation example possibly three bathers 41—enter room 1 and seat themselves behind the tubs 35. The swivel range of the conveyor and carrying device 27 is protected, at least optically, by stops 43.

In this way, the bathers can at least follow the last phase of the heating process of the stones 23. Of course, the heating facility 3 may also be located outside of the bathing room 1.

During the heating process, the bathing room is also heated up. Water (possibly containing additive substances) already added during this phase may be vaporized, if this should be required or desired.

After completion of the heating of the stones 23, the stone-cage 21 containing the heated stones is lifted and turned with the conveyor and carrying device 27, i.e. driven in the direction towards the first tub area 35(*a*). For this purpose, the tubs 35 and the location of the heating facility 3 are arranged in a semi-circle; however, the lengthwise movability of the extension arm of the swivel-hoist permits a different location choice in room 1.

Figure 3:
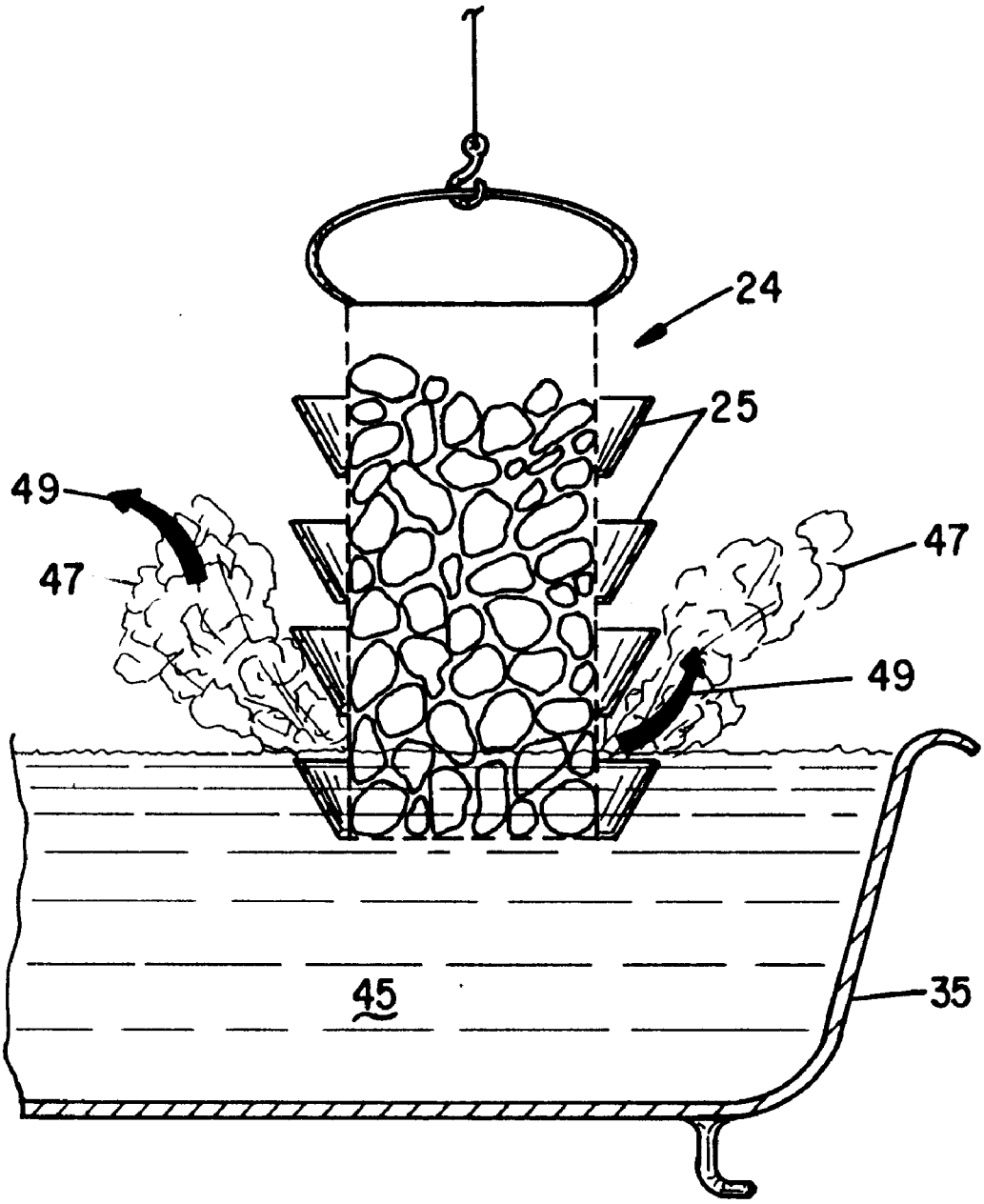

As the hold-and-carry container 21, i.e. stone-cage 21 with heated stones 23, is lifted by the crane-like conveyor and carrying device 27, it moves over a first tub 35*a,* and is lowered to partial height into bath water 45, as shown in the schematic vertical cut of FIG. 3. The strong superheating of the stones causes a shock-like vaporization of the bath water, as well as simultaneous heating of the bath water itself. The superheating of the stones achieves the desired, otherwise not attainable dissolving and/or release of agents and minerals contained in the stones, which are transferred into the bath water in dissolved condition, or may even be vaporized in the rising steam.

Essentially, the steam generation occurs only within the area into which the stone-cage 21—and with this, the stones 23—have been lowered into the bath water 45. The steam 47 rises mainly around the stone-cage 43 to the top because of the higher flow resistance caused by the stones in the interior of the cage. To divert the rising steam 47 from the layers of stones 23 that have not yet come in contact with liquid, the above mentioned baffles 25 are important because they assure that the largest part of the steam 47 can rise in direction of the arrows 49 upward and away from the cage.

The stone-cage 21 is subsequently lifted out of the tub 35*a* with the conveyor and carrying device 27, 29 and turned around the swivel axis of the crane towards the next tub 35*b* for immersion there, however, one step 51 (FIG. 1) lower, so that the second stone layer counted from below is submerged into the bath water 45 of the second tub 35*b,* causing the burst-like vaporization of the bath water, and contributing to the heating of the bath water there.

Corresponding to the number of tubs and the number of stone layers 51, several tubs can thus be heated one after another, and the steam be generated in bursts.

The agents dissolved in the bath water are mainly entrained during lifting the still hot stones 23 wetted by the bath water, and can thus be further vaporized to infuse the breathing air of the bathing room.

It is evident from the above explanations, especially in respect to FIG. 3, that the hot stones, which are heated, if necessary, to red glow, and contained in the hold-and-carry container 21, shall not simply be put into a tub 35 or a trough 37, but that the stone-cage dips without touching into the water contained in a tub 35 or in a water container 37, without coming into contact with the tub or water container. This assures that neither tub nor water container can be damaged in any way, i.e. mechanically, or by the superheated stone basket and the stones contained therein. Also, above all, the strongly superheated stones and the stone-cage (normally consisting of metal) are removed before a bather enters the tub, so that no scalding is to be feared here.

The lifting and lowering device of the crane-like conveyor and carrying device 27 shown in the implementation example is preferably driven by a motor. But a manual hoisting and lowering device, for example, with a corresponding reduction gear, is also feasible. A motor drive, especially an electric one, is not mandatory for the swivel motion from one tub to the next. Since an attendant is normally present, such job should be done by him. But, in principle, a motor-driven control may also be provided here, even controlling the hoisting device with a computer-supported program, by which the cage containing the hot stones can be moved from one to the next tub, to be lowered progressively at each successive tub, i.e. by one further step.

A relatively steamy and hot bathing room causes strong overheating of the bather's body before the tub bath. Preferably, the temperature of a subsequent tub bath should therefore be somewhat cooler, so that, corresponding to the desired temperature selection, the bath itself is felt like a cooling bath. In contrast, although a bathing room may be very steamy, it may also be relatively cool. In this case, the tub bath following the stay in the waiting area 53 may be sensed as pleasantly warm.

Alternatively and in addition, during the stay in room 1 or in the tub 35, the stone-cage 21 with the stones 23 may be dipped again into the water to generate additional steam or bursts of steam, for which purpose the mentioned additional tub containers or troughs 37 have been provided between the tubs 35.

The explained treatment facility is applicable to the case in which it is located in a room 1. Principally, it can also be placed in an open area for bath and steam use, although more vapor escapes into open space here.

What is claimed is:

1. A treatment facility for the application of a steam bath characterized by the following features:

(a) a heating facility for heating stones;

(b) at least one water container selected from the group consisting of water basins and tubs;

(c) a hold-and-carry container for holding a large number of the stones;

(d) wherein the hold-and-carry container is fireproof and of an open structure designed to be penetrable by air and water and to expose the stones to the exterior thereof such that, when said hold-and-carry container is immersed in the water in said at least one water container, the stones contact the water to generate steam; and (e) a conveying and carrying device for holding and manipulating the hold-and-carry container for moving the heated stones from the heating facility into said at least one water container.

2. The treatment facility of claim 1 wherein the hold-and-carry container is of a cage-like construction.

3. The treatment facility as recited in claim 2 further including diverter baffles arranged at at least one intermediate height around the outer periphery of the hold-and-carry container and extending for a part of the periphery of the hold and carry container, said baffles further being disposed to extend away from the hold-and-carry container at an acute angle.

4. The treatment facility of claim 1 wherein the height of the hold-and-carry container is greater than any horizontal dimension thereof.

5. The treatment facility as recited in claim 4 further including diverter baffles arranged at at least one intermediate height around the outer periphery of the hold-and-carry container and extending for a part of the periphery of the hold and carry container, said baffles further being disposed to extend away from the hold-and-carry container at an acute angle.

6. The treatment facility of claim 1 wherein the height of the hold-and-carry container is greater than its diameter.

7. The treatment facility as recited in claim 1 further including diverter baffles arranged at at least one intermediate height around the outer periphery of the hold-and-carry container and extending for a part of the periphery of the hold and carry container, said baffles further being disposed to extend away from the hold-and-carry container at an acute angle.

8. The treatment facility as recited in claim 7 characterized by the attachment of the diverter baffles to the hold-and-carry container at a plurality of levels of intermediate height.

9. The treatment facility as recited in claim 1 wherein said conveying and carrying device selected from the group consisting of cranes and hanging rails.

10. The treatment facility of claim 1 wherein the hold-and-carry container is immersed gradually in a plurality of steps to different depths in said at least one water container so that different relative amounts of stones are immersed.

11. The treatment facility of claim 10 wherein the hold-and-carry container filled with stones may be lowered to a deeper level into the water in each of a series of successive water containers so that hot stones not previously immersed may be used to heat the water in each successive water container.

12. The treatment facility of claim 1 wherein a plurality of water containers are arranged along a semi-circle and wherein the conveying and carrying device further comprises a swivel arm pivotally mounted for lift and rotation in the center of the semi-circle.

13. The treatment facility of claim 1 wherein the heating facility is arranged on an arcuate path along with the at least one water container and wherein the conveying and carrying device further comprises a vertical swivel arm having a rotational axis pivotally mounted at the center of the arc.

14. The treatment facility of claim 1 wherein the heating facility comprises an open fireplace above which the hold-and-carry container filled with stones may be positioned for the heating of the stones.

15. The treatment facility of claim 1 wherein said heating facility includes a plurality of openings for applying heat to the stones.

16. The treatment facility of claim 1 including means for hanging said hold-and-carry container enabling it to be lowered by means of the conveying and carrying device in a hanging position for immersion into the water contained in said at least one water container.

17. The treatment facility as recited in claim 6 wherein the heated stones contained in the hold-and-carry container do not contact said at least one water container.

18. The treatment facility as recited in claim 17 wherein the hold-and-carry container is anchored to and held by the conveying and carrying device in such a way that, at least for a pre-selectable period, the hold-and-carry container causes the hold-and-carry container to be contained in said at least one water container at least to a partial depth without contacting the at least one water container.

* * * * *